US009728146B2

(12) United States Patent
Matsushima

(10) Patent No.: US 9,728,146 B2
(45) Date of Patent: Aug. 8, 2017

(54) LIQUID-CRYSTAL DISPLAY DEVICE AND ELECTRONIC APPARATUS

(71) Applicant: Japan Display Inc., Tokyo (JP)

(72) Inventor: Toshiharu Matsushima, Tokyo (JP)

(73) Assignee: Japan Display Inc., Tokyo (JP)

( * ) Notice: Subject to any disclaimer, the term of this patent is extended or adjusted under 35 U.S.C. 154(b) by 38 days.

(21) Appl. No.: 14/219,236

(22) Filed: Mar. 19, 2014

(65) Prior Publication Data

US 2014/0292833 A1 Oct. 2, 2014

(30) Foreign Application Priority Data

Mar. 26, 2013 (JP) ..... 2013-065095

(51) Int. Cl.
*G09G 3/36* (2006.01)

(52) U.S. Cl.
CPC ..... *G09G 3/3648* (2013.01); *G09G 2320/041* (2013.01)

(58) Field of Classification Search
CPC ..... G09G 3/3648; G09G 2320/041
See application file for complete search history.

(56) References Cited

U.S. PATENT DOCUMENTS

2005/0024546 A1* 2/2005 Kubo et al. ..... 349/33
2006/0050038 A1* 3/2006 Cheon et al. ..... 345/89
2006/0158415 A1* 7/2006 Izumi ..... 345/98
2008/0129671 A1* 6/2008 Shen et al. ..... 345/88
2009/0015532 A1* 1/2009 Katayama ..... G09G 3/3406 345/89
2009/0267930 A1* 10/2009 Sumi ..... 345/211
2014/0292833 A1* 10/2014 Matsushima ..... 345/690

FOREIGN PATENT DOCUMENTS

JP 2007-219392 8/2007
JP 2009-020340 1/2009
JP 2010-109578 5/2010
WO 2007/074560 7/2007

OTHER PUBLICATIONS

English translation of WO 2007/074560, pp. 1-47.*
Japanese Office Action dated Mar. 1, 2016 in corresponding Japanese Application No. 2013-065095.

* cited by examiner

*Primary Examiner* — Dorothy Harris
(74) *Attorney, Agent, or Firm* — K&L Gates LLP

(57) ABSTRACT

According to an aspect, a liquid-crystal display device includes: a liquid crystal layer including a pixel; a driving circuit unit for applying a driving voltage to the pixel; a status detection unit that detects a response speed of the liquid crystal layer; and a control unit that controls a gradation of the pixel by controlling the driving voltage. The control unit switches between a first mode and a second mode based on a detection result from the status detection unit. In the first mode, the control unit uses each of a predetermined number of voltage values from a minimum voltage value to a maximum voltage as a voltage value of the driving voltage corresponding to a gradation value. In the second mode, the control unit uses part of the predetermined number of voltage values as a voltage value of the driving voltage for overdrive.

8 Claims, 8 Drawing Sheets

D1

| | | | VOLTAGE VALUE |
|---|---|---|---|
| GRADA-TION | BRIGHT | 255 | $Vd_{255}$ |
| | | 254 | $Vd_{254}$ |
| | | 253 | $Vd_{253}$ |
| | | 252 | $Vd_{252}$ |
| | | ⋮ | ⋮ |
| | | 3 | $Vd_3$ |
| | | 2 | $Vd_2$ |
| | | 1 | $Vd_1$ |
| | DARK | 0 | $Vd_0$ |

D2

| | | | VOLTAGE VALUE |
|---|---|---|---|
| DRIVING VOLTAGE FOR OD | | 255 | $Vd_{255}$ |
| | | 254 | $Vd_{254}$ |
| | | ⋮ | ⋮ |
| | | 129 | $Vd_{129}$ |
| | | 128 | $Vd_{128}$ |
| GRADA-TION | BRIGHT | 127 | $Vd_{127}$ |
| | | 126 | $Vd_{126}$ |
| | | ⋮ | ⋮ |
| | | 1 | $Vd_1$ |
| | DARK | 0 | $Vd_0$ |

FIG.5

D1

| | | | VOLTAGE VALUE |
|---|---|---|---|
| GRADA-TION | BRIGHT | 255 | $Vd_{255}$ |
| | | 254 | $Vd_{254}$ |
| | | 253 | $Vd_{253}$ |
| | | 252 | $Vd_{252}$ |
| | | ⋮ | ⋮ |
| | | 3 | $Vd_3$ |
| | | 2 | $Vd_2$ |
| | | 1 | $Vd_1$ |
| | DARK | 0 | $Vd_0$ |

FIG.6

D2

| | | | VOLTAGE VALUE |
|---|---|---|---|
| DRIVING VOLTAGE FOR OD | | 255 | $Vd_{255}$ |
| | | 254 | $Vd_{254}$ |
| | | ⋮ | ⋮ |
| | | 129 | $Vd_{129}$ |
| | | 128 | $Vd_{128}$ |
| GRADA-TION | BRIGHT | 127 | $Vd_{127}$ |
| | | 126 | $Vd_{126}$ |
| | | ⋮ | ⋮ |
| | | 1 | $Vd_1$ |
| | DARK | 0 | $Vd_0$ |

LIQUID-CRYSTAL DISPLAY DEVICE AND ELECTRONIC APPARATUS

CROSS REFERENCES TO RELATED APPLICATIONS

The present application claims priority to Japanese Priority Patent Application JP 2013-065095 filed in the Japan Patent Office on Mar. 26, 2013, the entire content of which is hereby incorporated by reference.

BACKGROUND

1. Technical Field

The present disclosure relates to a liquid-crystal display device and an electronic apparatus.

2. Description of the Related Art

Liquid-crystal display devices include transmissive-type liquid-crystal display devices that displays an image by using transmission light from a backlight provided on a backside of a screen. Some of this type of liquid-crystal display devices control brightness and darkness of a pixel with 0 to 255 gradations (so-called "256 gradation" or "8 bit display") (see Japanese Patent Application Laid-Open No. 2007-219392). In the liquid-crystal display device, when an ambient temperature is low, a response speed of a liquid crystal is decreased. Therefore, in order to improve the response speed of the liquid crystal, the liquid-crystal display device performs so-called "overdrive" in which a driving voltage for driving the liquid crystal is set to a voltage higher than a normal driving voltage.

Some liquid-crystal display devices improve the responsiveness of the liquid crystal by using a range that exhibits a fast response of the liquid crystal, when the liquid-crystal display device is used under an ambient temperature that decreases the responsiveness of the liquid crystal (see Japanese Patent Application Laid-Open No. 2010-109578). Specifically, in this type of liquid-crystal display device, a range that exhibits a fast response of the liquid crystal is set such that a black level becomes 15% of brightness of the liquid-crystal display device and a white level becomes 85% of the brightness of the liquid-crystal display device.

In this manner, when the response speed of the liquid crystal is decreased in a low ambient temperature, the liquid-crystal display device improves the response speed of the liquid crystal by performing a overdrive that applies a driving voltage higher than a target driving voltage corresponding to a target gradation in order to render a gradation of a pixel to meet a target gradation. In this case, when the gradation of each pixel of the liquid-crystal display device is controlled with 256 gradations, voltage values of the driving voltage a prepared as many as the number corresponding to 256 gradations. That is, in the liquid-crystal display device, 256 voltage values of the driving voltage are prepared, with which 0 to 255 gradation are associated. When performing the overdrive, in the liquid-crystal display device, it is required to prepare a voltage value of the driving voltage for the overdrive as well as the 256 voltage values for executing the gradation control with 256 gradations. Therefore, in the liquid-crystal display device, in order to perform the overdrive when the response speed of the liquid crystal is decreased, it is required to prepare voltage values equal to or more than the voltage values used in an 8-bit display as the voltage value of the driving voltage. In this case, as the voltage values of the driving voltage increases, a control load on the liquid-crystal display device increases.

For the foregoing reasons, there is a need for a liquid crystal display device that can suppress an increase of the control load, and an electronic apparatus including the same.

SUMMARY

According to an aspect, a liquid-crystal display device includes: a pixel electrode provided for each pixel; a common electrode for supplying a common potential to the pixel; a liquid crystal layer arranged between the pixel electrode and the common electrode; a driving circuit unit for supplying a pixel potential to the pixel electrode so that that a driving voltage is applied between the common electrode and the pixel electrode; a status detection unit that detects a response speed of the liquid crystal layer; and a control unit that controls a gradation of the pixel by controlling the driving voltage. The control unit switches between a first gradation control mode and a second gradation control mode based on a detection result from the status detection unit. The first gradation control mode is selected when the response speed of the liquid crystal layer is higher than a predetermined speed. The second gradation control mode is selected when the response speed of the liquid crystal layer is not higher than the predetermined speed. In the first gradation control mode, a predetermined number of voltage values of the driving voltage from a minimum voltage value to a maximum voltage value are prepared, and the predetermined number of voltage values are associated with a plurality of gradation values from a minimum gradation value to a maximum gradation value. In the second gradation control mode, a plurality of voltage values from the minimum voltage value to a predetermined voltage value among the predetermined number of voltage values are associated with a plurality of gradation values from a minimum gradation value to a maximum gradation value, whose number is smaller than that in the first gradation control mode, and a plurality of voltage values from the predetermined voltage value to the maximum voltage value among the predetermined number of voltage values are set as voltage values for overdrive for applying a voltage value that is higher than the driving voltage of the voltage value associated with the gradation value.

According to another aspect, a liquid-crystal display device includes: a liquid crystal layer including a pixel; a driving circuit unit for applying a driving voltage to the pixel; a status detection unit that detects a response speed of the liquid crystal layer; and a control unit that controls a gradation of the pixel by controlling the driving voltage. The control unit switches between a first mode and a second mode based on a detection result from the status detection unit. In the first mode, the control unit uses each of a predetermined number of voltage values from a minimum voltage value to a maximum voltage as a voltage value of the driving voltage corresponding to a gradation value. In the second mode, the control unit uses part of the predetermined number of voltage values as a voltage value of the driving voltage for overdrive.

According to another aspect, an electronic apparatus includes the liquid-crystal display device.

Additional features and advantages are described herein, and will be apparent from the following Detailed Description and the figures.

BRIEF DESCRIPTION OF THE FIGURES

FIG. 5 is an explanatory diagram of an example of normal-temperature gradation control data;

FIG. 6 is an explanatory diagram of an example of low-temperature gradation control data;

DETAILED DESCRIPTION

Modes (hereinafter, "embodiments") for implementing the technique of the present disclosure will be described below in detail with the following procedures with reference to the accompanying drawings in the order as follows.

1. Liquid-crystal display device according to an embodiment
2. Evaluation example
3. Application example
4. Aspects of the present disclosure

1. Liquid-Crystal Display Device According to an Embodiment

Figure 1:
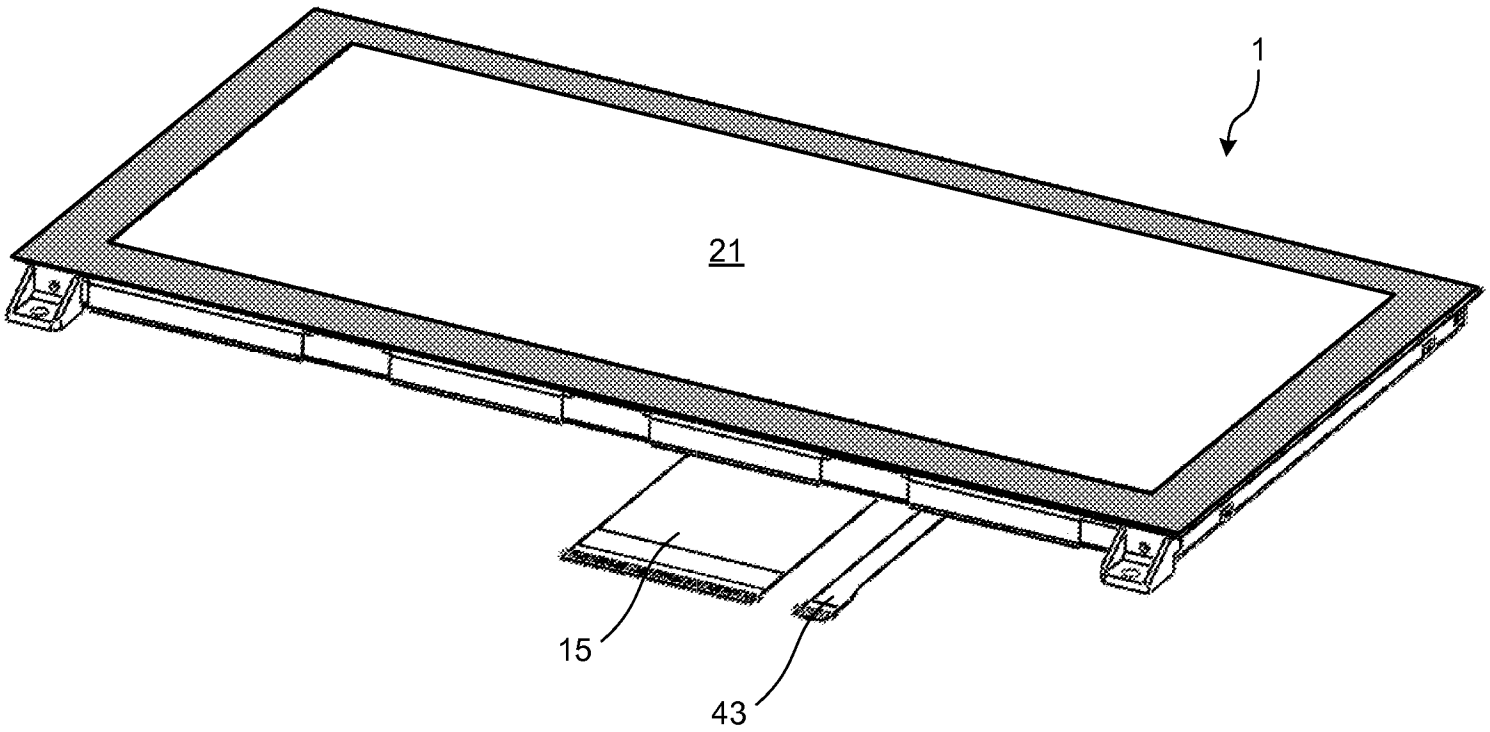
FIG. 1 is an overall perspective view of a liquid-crystal display device according to an embodiment of the present disclosure.
Figure 2:
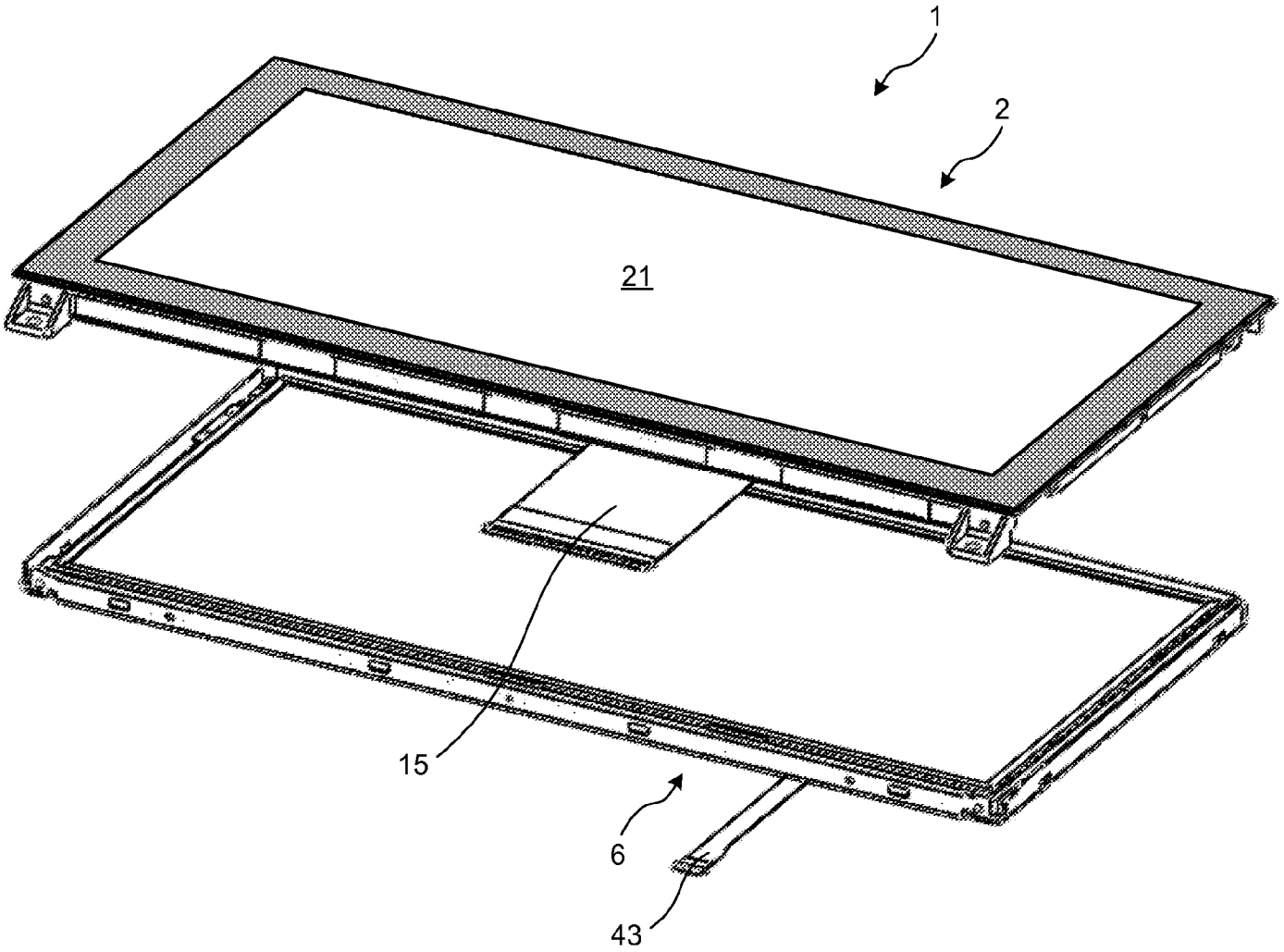
FIG. 2 is an exploded perspective view of the liquid-crystal display device according to the embodiment.
Figure 3:
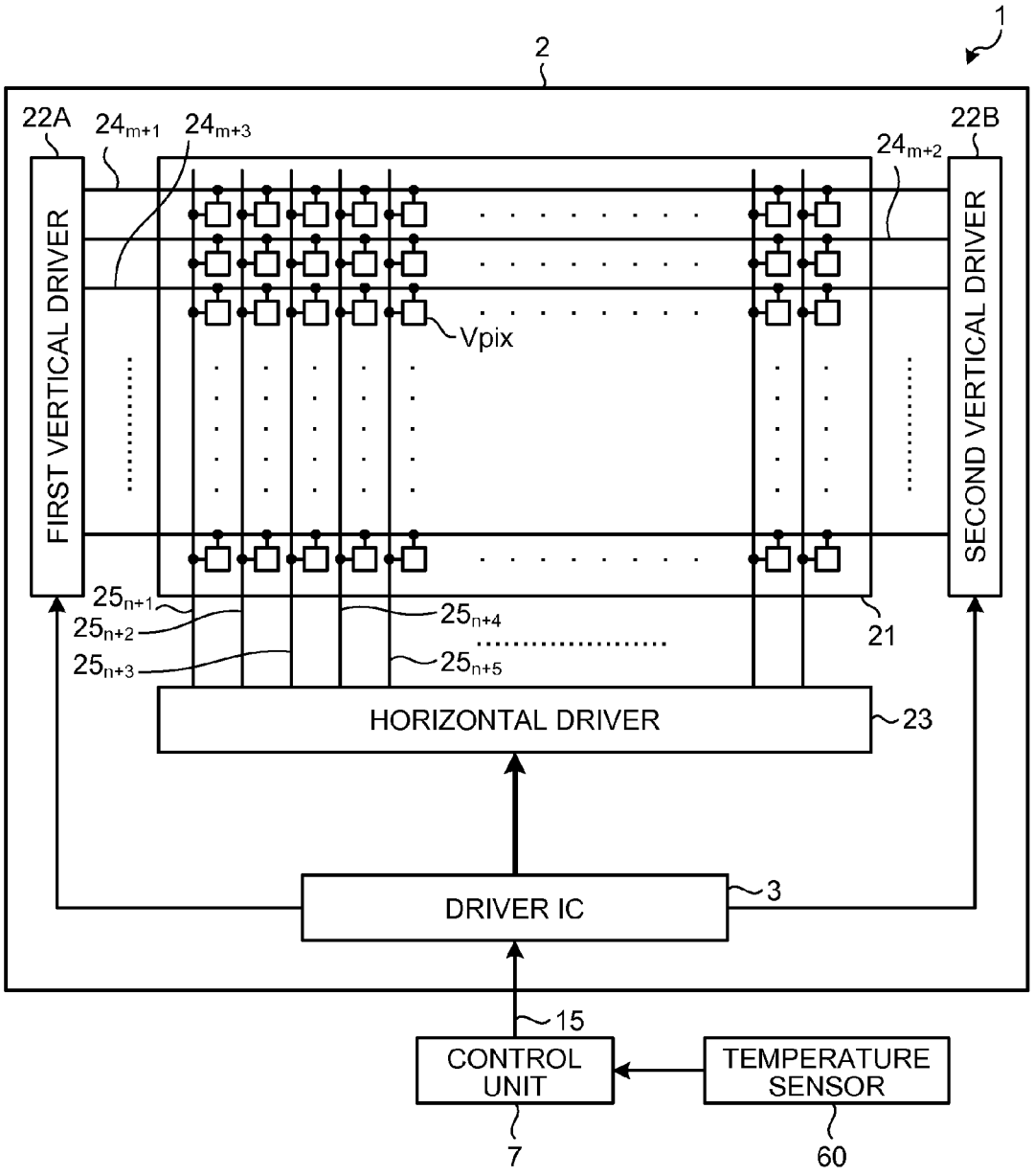
FIG. 3 is a block diagram illustrating an example of a system configuration of the liquid-crystal display device illustrated in FIG. 1.
Figure 4:
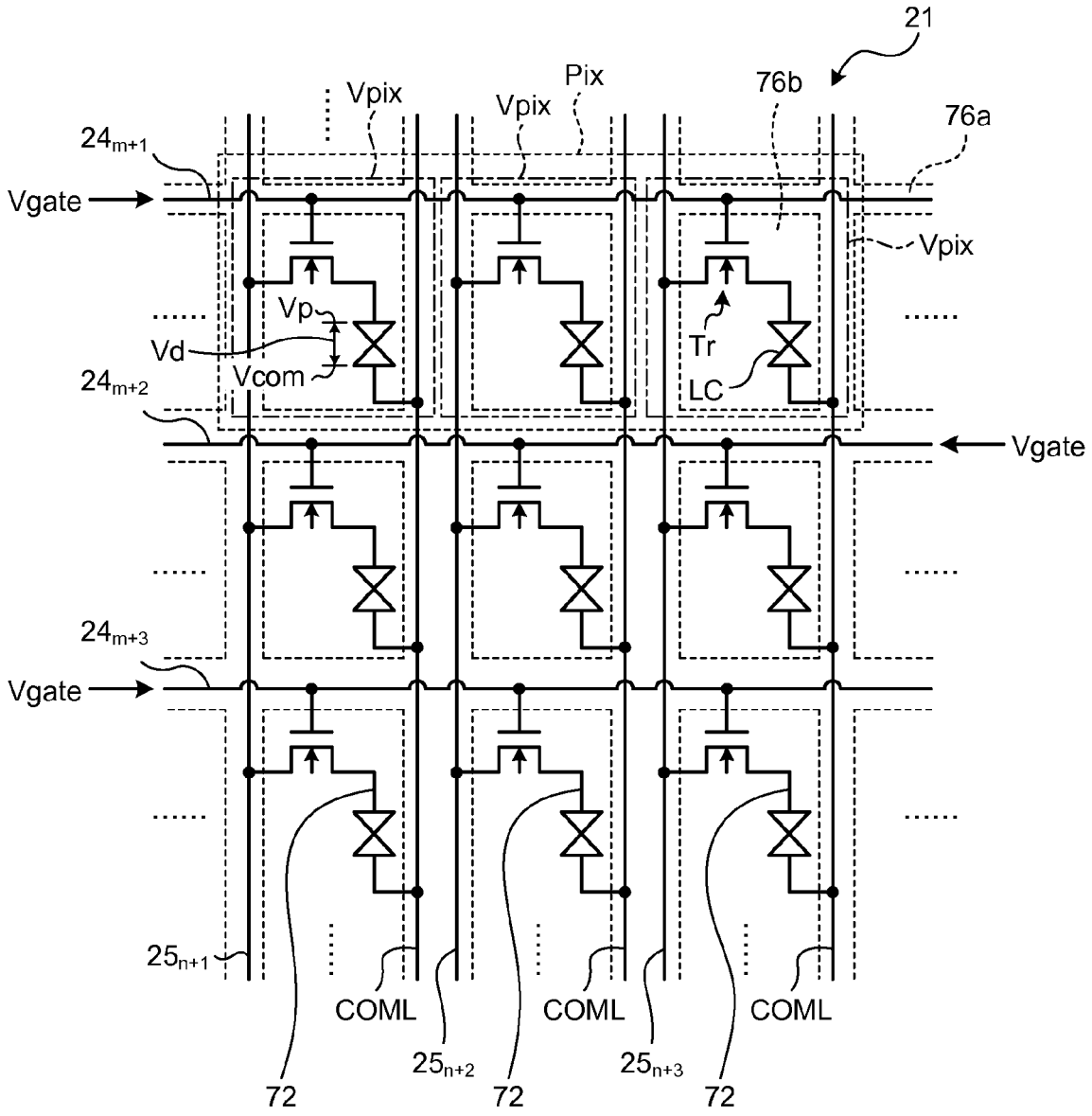
FIG. 4 is a circuit diagram of an example of a driving circuit for driving a pixel.

FIG. 1 is an overall perspective view of a liquid-crystal display device according to an embodiment of the present disclosure, and FIG. 2 is an exploded perspective view of the liquid-crystal display device according to the embodiment. FIG. 3 is a block diagram of an example of a system configuration of the liquid-crystal display device illustrated in FIG. 1, and FIG. 4 is a circuit diagram of an example of a driving circuit for driving a pixel. FIGS. 1 and 2 are schematic diagrams, and hence dimensions and shapes are not necessarily identical to those of the actual ones. A configuration of a liquid-crystal display device 1 according to the embodiment is described below with reference to FIGS. 1 to 4.

The liquid-crystal display device 1 is a display device employing a liquid crystal display (LCD) panel. Depending on a display scheme, the liquid-crystal display device 1 can be classified as a transmissive type and a reflective type. The liquid-crystal display device 1 according to the embodiment is a liquid-crystal display device of the transmissive type or a semi-transmissive type having features of both the transmissive type and the reflective type. That is, the embodiment can be applied to a liquid-crystal display device so long as it performs a display of an image by using transmission light from a backlight provided on a backside of a screen, and is applied to a transmissive-type liquid-crystal display device in the following descriptions. However, the liquid-crystal display device 1 can also be applied to a reflective-type liquid-crystal display device.

As illustrated in FIGS. 1 to 4, the liquid-crystal display device 1 according to the embodiment includes a liquid-crystal display panel 2, a backlight 6, and a control unit 7. In the liquid-crystal display device 1, the liquid-crystal display panel 2 is mounted on the backlight 6, so that the liquid-crystal display panel 2 is illuminated by the backlight 6 to display an image on the liquid-crystal display panel 2. The liquid-crystal display device 1 further includes a flexible printed circuit (FPC) 15. The FPC 15 couples the liquid-crystal display panel 2 and the control unit 7. The FPC 16 transmits a control signal for controlling a display operation of the liquid-crystal display panel 2 output from the control unit 7 to the liquid-crystal display panel 2.

The liquid-crystal display panel 2 includes a liquid crystal layer (a layer including liquid crystal LC to be described later) between two transparent substrates. The liquid-crystal display panel 2 according to the embodiment is an FFS (Fringe Field Switching) mode liquid-crystal display panel. In the liquid-crystal display panel 2, pixel electrodes 72 and a common electrode COML are provided on one of the transparent substrates to form a part of respective pixels Vpix, which are arranged in a matrix form. The liquid-crystal display panel 2 further includes a color filter provided on at least one of the two transparent substrates. The color filter includes a lattice-shaped black matrix 76*a* and color filters, such as R (Red), G (Green), and B (Blue), provided at opening portions 76*b* of the black matrix 76*a*, and the color filters are arranged corresponding to pixels Vpix, respectively. The liquid-crystal display panel 2 includes openings formed on the pixel electrodes 72 or on the common electrode COML, and drives the liquid crystal with electric fields (fringe electric fields) leaking from the openings. The liquid-crystal display panel 2 displays an image by switching transmitting and blocking the light at each pixel Vpix based on a control signal from the control unit 7. In the liquid-crystal display panel 2, an area where the pixels Vpix are arranged in a matrix form is defined as a display area 21. In the liquid-crystal display panel 2, a surface where the display area 21 is arranged, that is, a surface having the largest area (a panel surface, a front surface) is arranged in substantially parallel to an irradiation surface of the backlight 6. In the embodiment, the liquid-crystal display panel 2 is described as an FFS mode; however, the liquid-crystal display panel 2 can also employ IPS (In-Plane Switching) mode, a TN (Twisted Nematic) mode, an OCB (Optically Compensated Bend, Optically Compensated Birefringence) mode, or an ECB (Electrically Controlled Birefringence) mode.

The backlight 6 is arranged facing a rear surface side (a surface opposite to the surface on which the image is displayed) of the liquid-crystal display panel 2, and irradiates light on the liquid-crystal display panel 2. The backlight 6 includes a light source that outputs the light, and a light guide plate that receives the light output from the light source and guides the light toward the liquid-crystal display panel 2. As the light source, an LED (Light Emitting Diode) or a fluorescent light can be used. Further, a flexible cable 43 illustrated in FIG. 1 is coupled to the light source, through which the light source is coupled to a power source. In the embodiment, the LED or the fluorescent light and the light guide plate is employed as the backlight 6 to output the light from an emitting surface of the light guide plate; however, the embodiment is not limited thereto. As the backlight 6, a point light source such as an LED or a line light source such as a cold cathode fluorescent lamp (CCFL) can be used. The backlight 6 can also be configured to incident the light to the entire surface of the display surface of the liquid-crystal display panel 2 by arranging a plurality of point light sources or line light sources.

Driving System for Driving Liquid-Crystal Display Panel

A structure of each pixel Vpix in the liquid-crystal display panel 2 is described below with reference to FIGS. 3 and 4. The liquid-crystal display panel 2 includes a plurality of pixels Vpix, a driver IC 3, a horizontal driver (horizontal driving circuit) 23, and vertical drivers (vertical driving circuits) 22A and 22B. The driving circuit unit for driving the pixels Vpix includes the horizontal driver 23 and the vertical drivers 22A and 22B.

As illustrated in FIG. 3, the liquid-crystal display panel 2 has a matrix (matrix shape) structure in which the pixels Vpix including the liquid crystal layer (liquid crystal LC to be described later) are arranged in M rows by N columns in the display area 21. In the embodiment, the row indicates a pixel row including N pixels Vpix arranged in one direction. The column indicates a pixel column including M pixels Vpix arranged in a direction perpendicular to the direction in which the row is arranged. Values of M and N are determined based on a display resolution in a vertical direction and a display resolution in a horizontal direction. In the pixel Vpix illustrated in FIG. 4, color areas of three colors of R, G, and B correspond to a pixel Pix as a set.

In the liquid-crystal display panel 2, scanning lines $\mathbf{24}_1$, $\mathbf{24}_2$, $\mathbf{24}_3$, . . . , and $\mathbf{24}_M$ are wired for each row, and signal lines $\mathbf{25}_1$, $\mathbf{25}_2$, $\mathbf{25}_3$, . . . , and $\mathbf{25}_N$ are wired for each column with respect to the array of M rows by N columns of the pixels Vpix. Hereinafter, in the embodiment, the scanning lines $\mathbf{24}_1$, $\mathbf{24}_2$, $\mathbf{24}_3$, . . . , and $\mathbf{24}_M$ may be representatively denoted as scanning line 24 or scanning line $\mathbf{24}_m$, and the signal lines $\mathbf{25}_1$, $\mathbf{25}_2$, $\mathbf{25}_3$, . . . , and $\mathbf{25}_N$ may be representatively denoted as signal line 25 or signal line $\mathbf{25}_n$. In the embodiment, the scanning lines $\mathbf{24}_1$, $\mathbf{24}_2$, $\mathbf{24}_3$, . . . , and $\mathbf{24}_M$ may be representatively denoted as scanning lines $\mathbf{24}_{m+1}$, $\mathbf{24}_{m+2}$, $\mathbf{24}_{m+3}$, . . . , and the signal lines $\mathbf{25}_1$, $\mathbf{25}_2$, $\mathbf{25}_3$, . . . , and $\mathbf{25}_n$ may be representatively denoted as signal lines $\mathbf{25}_{n+1}$, $\mathbf{25}_{n+2}$, $\mathbf{25}_{n+3}$, . . . . When viewed from a viewing direction that intersects with a display surface of the liquid-crystal display panel 2, the scanning line 24 and the signal line 25 are arranged in an area that is overlapped with the black matrix 76*a* of a color filter (see FIG. 4). In the liquid-crystal display panel 2, the opening portion 76*b* is defined as an area where the black matrix 76*a* is not arranged.

The pixel Vpix includes a thin film transistor (TFT) Tr and liquid crystal LC. The thin film transistor Tr is an n-channel MOS (Metal Oxide Semiconductor) TFT in this example. One of a source and a drain of the thin film transistor Tr is coupled to one of the signal lines $\mathbf{25}_{n+1}$, $\mathbf{25}_{n+2}$, and $\mathbf{25}_{n+3}$, a gate thereof is coupled to one of the scanning lines $\mathbf{24}_{m+1}$, $\mathbf{24}_{m+2}$, and $\mathbf{24}_{m+3}$, and the other of the source and the drain is coupled to the pixel electrode 72.

The liquid crystal LC is provided between the pixel electrode 72 and the common electrode COML. The pixel electrode 72 is coupled to the thin film transistor Tr, and is applied with a pixel potential Vp from the thin film transistor Tr, separately for each pixel Vpix. The common electrode COML is applied with a common potential Vcom of a direct-current voltage, which is common to all pixels.

Control signals from the control unit 7, such as a master clock, a horizontal synchronization signal, and a vertical synchronization signal, are input to the liquid-crystal display panel 2, and supplied to the driver IC 3. Further, a temperature sensor 60 is coupled to the control unit 7. The temperature sensor 60 is used in a gradation control to be described later. The temperature sensor 60, which is preferably provided in proximity to the liquid-crystal display panel 2, detects a temperature in a usage environment of the liquid-crystal display panel 2. The temperature sensor 60 outputs a detection result to the control unit 7.

The driver IC 3 converts (boosts) levels of the master clock, the horizontal synchronization signal, and the vertical synchronization signal having a voltage amplitude of an external power source into levels of a voltage amplitude of an internal power source required to drive the liquid crystal, to generate a master clock, a horizontal synchronization signal, and a vertical synchronization signal. The driver IC 3 supplies the generated master clock, horizontal synchronization signal, and vertical synchronization signal to the first vertical driver 22A, the second vertical driver 22B, and the horizontal driver 23. The driver IC 3 further generates the common potential Vcom to be commonly supplied to the pixels, and supplies the generated common potential Vcom to the common electrode COML.

Each of the first vertical driver 22A and the second vertical driver 22B includes a shift register to be described later, and further includes a latch circuit and the like. The latch circuit of each of the first vertical driver 22A and the second vertical driver 22B sequentially samples and latches display data output from the driver IC 3 in synchronization with a vertical clock pulse within one horizontal period. Each of the first vertical driver 22A and the second vertical driver 22B sequentially outputs digital data of one line latched in the latch circuit as a vertical scanning pulse, and sequentially selects the pixels Vpix in units of row by supplying the vertical scanning pulse to the scanning lines $\mathbf{24}_{m+1}$, $\mathbf{24}_{m+2}$, $\mathbf{24}_{m+3}$, . . . of the liquid-crystal display panel 2. The first vertical driver 22A and the second vertical driver 22B are arranged to sandwich the scanning lines $\mathbf{24}_{m+1}$, $\mathbf{24}_{m+2}$, $\mathbf{24}_{m+3}$, . . . in a direction along which the scanning lines $\mathbf{24}_{m+1}$, $\mathbf{24}_{m+2}$, $\mathbf{24}_{m+3}$, . . . are extended. For example, each of the first vertical driver 22A and the second vertical driver 22B sequentially outputs the digital data from a vertical scanning upper direction nearer a top of the liquid-crystal display panel 2 of the scanning lines $\mathbf{24}_{m+1}$, $\mathbf{24}_{m+2}$, $\mathbf{24}_{m+3}$, . . . to a vertical scanning lower direction nearer a bottom of the liquid-crystal display panel 2. Alternatively, each of the first vertical driver 22A and the second vertical driver 22B can also sequentially outputs the digital data from the vertical scanning lower direction nearer the bottom of the liquid-crystal display panel 2 of the scanning lines $\mathbf{24}_{m+1}$, $\mathbf{24}_{m+2}$, $\mathbf{24}_{m+3}$, . . . to the vertical scanning upper direction nearer the top of the liquid-crystal display panel 2.

For example, 8-bit digital video data of R (red), G (green), and B (blue) is supplied to the horizontal driver 23. The horizontal driver 23 writes the display data via the signal line 25 for each pixel, each group of a plurality of pixels, or all pixels all together with respect to the pixels Vpix of the row selected based on the vertical scanning by the first vertical driver 22A and the second vertical driver 22B.

In this manner, the wirings are formed in the liquid-crystal display panel 2, such as the signal lines $\mathbf{25}_{n+1}$, $\mathbf{25}_{n+2}$, and $\mathbf{25}_{n+3}$ for supplying a pixel signal to the thin film transistor Tr of each pixel Vpix illustrated in FIG. 4 as the display data, and the scanning lines $\mathbf{24}_{m+1}$, $\mathbf{24}_{m+2}$, $\mathbf{24}_{m+3}$, and the like for driving the thin film transistor Tr. The signal lines $\mathbf{25}_{n+1}$, $\mathbf{25}_{n+2}$, and $\mathbf{25}_{n+3}$ are extended on a plane parallel to the surface of the liquid-crystal display panel 2, and supply the pixel signals for displaying an image on the pixels Vpix.

The pixels Vpix are coupled to the other pixels Vpix that belong to the same row of the liquid-crystal display panel 2 by the scanning lines $\mathbf{24}_{m+1}$, $\mathbf{24}_{m+2}$, and $\mathbf{24}_{m+3}$. The odd-numbered scanning lines $\mathbf{24}_{m+1}$ and $\mathbf{24}_{m+3}$ among the scanning lines $\mathbf{24}_{m+1}$, $\mathbf{24}_{m+2}$, and $\mathbf{24}_{m+3}$ are coupled to the first vertical driver 22A, and are supplied with a vertical scanning pulse Vgate of a scanning signal to be described later from the first vertical driver 22A. The even-numbered scanning lines $\mathbf{24}_{m+2}$ and $\mathbf{24}_{m+4}$ among the scanning lines $\mathbf{24}_{m+1}$, $\mathbf{24}_{m+2}$, and $\mathbf{24}_{m+3}$ are coupled to the second vertical driver 22B, and are supplied with a vertical scanning pulse Vgate to be described later from the second vertical driver 22B. In this manner, the first vertical driver 22A and the second vertical driver 22B apply the vertical scanning pulse Vgate to the scanning lines $\mathbf{24}_{m+1}$, $\mathbf{24}_{m+2}$, and $\mathbf{24}_{m+3}$ in the scanning direction in an alternate manner. Further, the pixels Vpix are coupled to the other pixels Vpix that belong to the same column of the liquid-crystal display panel 2 by the signal lines $\mathbf{25}_{n+1}$, $\mathbf{25}_{n+2}$, and $\mathbf{25}_{n+3}$. The signal lines $\mathbf{25}_{n+1}$, $\mathbf{25}_{n+2}$, and $\mathbf{25}_{n+3}$ are coupled to the horizontal driver 23, and are supplied with the pixel signals from the horizontal driver 23. The common electrode COML is coupled to the driver IC 3, and is supplied with common potential Vcom from the driver IC 3. The pixels Vpix are also coupled to the other pixels Vpix that belong to the same column of the liquid-crystal display panel 2 via the common electrode COML.

The first vertical driver 22A and the second vertical driver 22B illustrated in FIG. 3 sequentially select one row (one horizontal line) among the pixels Vpix formed in a matrix shape on the liquid-crystal display panel 2 as a target of a display drive by applying the vertical scanning pulse Vgate to the gates of the thin film transistors Tr of the pixels Vpix via the scanning lines $\mathbf{24}_{m+1}$, $\mathbf{24}_{m+2}$, and $\mathbf{24}_{m+3}$. The horizontal driver 23 illustrated in FIG. 3 supplies the pixel signal to each pixel Vpix included in the one horizontal line sequentially selected by the first vertical driver 22A and the second vertical driver 22B via the signal lines $\mathbf{25}_{n+1}$, $\mathbf{25}_{n+2}$, and $\mathbf{25}_{n+3}$. Thus, these pixels Vpix perform display of one horizontal line in response to the supplied pixel signal.

The liquid-crystal display panel 2 (the liquid-crystal display device 1) adopts a driving method for inverting the polarity of a video signal at a predetermined cycle with reference to the common potential Vcom, in order to suppress degradation of a specific resistance (unique resistance value of material) of the liquid crystal due to a constant application of a direct-current voltage of the same polarity to the liquid crystal.

As a driving method for driving the liquid-crystal display panel, a column inversion method, a line inversion method, a dot inversion method, a frame inversion method, and the like are generally known. The column inversion method is a driving method that inverts the polarity of the video signal at a time cycle of 1 V (V is a vertical period) corresponding to one column (one pixel column). The line inversion method is a driving method that inverts the polarity of the video signal at a time cycle of 1 H (H is a horizontal period) corresponding to one line (one pixel row). The dot inversion method is a driving method that alternately inverts the polarity of the video signal for each of pixels adjacent to each other on the left, right, top, and bottom. The frame inversion method is a driving method that inverts the polarity of the video signal to be written in all pixels in the same polarity at once for each frame corresponding to one picture. The liquid-crystal display panel 2 is configured to adopt any one of the driving methods described above.

Gradation Control by Control Unit

A gradation control by the control unit 7 is described below with reference to FIGS. 5 and 6. As described above, the pixel potential Vp is applied to the pixel electrode 72 from the thin film transistor Tr, and the common potential Vcom is applied to the common electrode COML from the driver IC 3. A potential difference between the common potential Vcom and the pixel potential Vp is a driving voltage Vd illustrated in FIG. 4, and the control unit 7 controls the gradation of each pixel Vpix by appropriately adjusting the voltage value of the driving voltage Vd. That is, the control unit 7 inputs a control signal corresponding to the driving voltage Vd to the driver IC 3, and controls the gradation of each pixel Vpix by the driving circuit unit including the horizontal driver 23 and the vertical drivers 22A and 22B.

The gradation of each pixel Vpix has, for example, 256 gradations from 0 gradation that is the minimum gradation value to 255 gradation that is the maximum gradation value, which performs a so-called "8-bit display". As each color of R, G, and B performs the 8-bit display, the pixel Pix can represent a 24-bit display, that is, about 16.77 million colors.

The control unit 7 stores gradation control data in which the voltage values of the driving voltage Vd are associated with the gradation values of each pixel Vpix, in order to control the gradation of each pixel Vpix by changing the voltage value of the driving voltage Vd. However, when the temperature of the usage environment of the liquid-crystal display panel 2 is low, the response speed of the liquid crystal LC is decreased. Therefore, in the liquid-crystal display device 1 according to the embodiment, a plurality of pieces of gradation control data are prepared according to the temperature of the usage environment, in order to execute the gradation control of the pixel Vpix.

For example, two types of gradation control data are prepared according to the usage environment. One of the two types of the gradation control data is normal-temperature gradation control data D1 used when the temperature of the usage environment of the liquid-crystal display panel 2 is a normal temperature. The other is low-temperature gradation control data D2 used when the temperature of the usage environment of the liquid-crystal display panel 2 is a low temperature.

The normal-temperature gradation control data D1 is used when the temperature of the usage environment is the normal temperature, and hence the normal-temperature gradation control data D1 is data in which a decrease in the response speed of the liquid crystal LC is not taken care of. Specifically, the normal-temperature gradation control data D1 includes 256 voltage values from the minimum voltage value to the maximum voltage value of the driving voltage Vd and 256 gradation values from the minimum gradation value to the maximum gradation value associated with each other. The 256 gradation values have the minimum gradation value of 0 gradation where the pixel Vpix is dark and the maximum gradation value of 255 gradation where the pixel is bright. In the 256 voltage values, the minimum voltage value (for example, 0 V) of the driving voltage Vd is $Vd_0$, and the maximum voltage value of the driving voltage Vd is $Vd_{255}$. Therefore, the pixel Vpix has the darkness of the minimum gradation value when the driving voltage Vd is the minimum voltage value $Vd_0$. On the other hand, the pixel Vpix has the brightness of the maximum gradation value when the driving voltage Vd is the maximum voltage value $Vd_{255}$. That is, the liquid-crystal display panel 2 adopts a normally black system in which the display becomes black (dark) without transmitting the light when there is no driving voltage Vd applied (when the driving voltage Vd is 0 V).

The low-temperature gradation control data D2 is used when the temperature of the usage environment is a low temperature, and hence the low-temperature gradation control data D2 is data in which a decrease in the response speed of the liquid crystal LC is taken care of. In the low-temperature gradation control data D2, the number of gradations of the normal-temperature gradation control data D1 for the 8-bit display is reduced (compressed), and the voltage values corresponding to the reduced number of gradations are assigned as the voltage values of the driving voltage Vd for the overdrive. That is, the low-temperature gradation control data D2 includes 128 voltage values from the minimum voltage value $Vd_0$ to a predetermined voltage value $Vd_{127}$ among the 256 voltage values and 128 gradations from the minimum gradation value to the maximum gradation value associated with each other. Further, the low-temperature gradation control data D2 uses 128 voltage values from a predetermined voltage value $Vd_{128}$ to the maximum voltage value $Vd_{255}$ among the 256 voltage values as the driving voltage Vd for the overdrive.

In this case, the number of gradations from the minimum gradation value to the maximum gradation value in the low-temperature gradation control data D2 is smaller than that in the normal-temperature gradation control data D1. Specifically, the number of gradations from the minimum gradation value to the maximum gradation value in the low-temperature gradation control data D2 is a half of that in the normal-temperature gradation control data D1. That is, while the normal-temperature gradation control data D1 corresponds to the 8-bit display (256 gradations), the low-temperature gradation control data D2 corresponds to a 7-bit display (128 gradations).

The control unit 7 switches a gradation control mode between a normal-temperature gradation control mode (first gradation control mode) for executing the gradation control by using the normal-temperature gradation control data D1 and a low-temperature gradation control mode (second gradation control mode) for executing the gradation control by using the low-temperature gradation control data D2, based on the temperature detected by the temperature sensor 60.

Upon performing the normal-temperature gradation control mode, the control unit 7 controls the gradation of each pixel Vpix of the liquid-crystal display panel 2 based on the normal-temperature gradation control data D1. That is, the control unit 7 outputs a control signal based on the normal-temperature gradation control data D1 to the driver IC 3. Therefore, in the normal-temperature gradation control mode, each pixel Vpix can be displayed with the 256 gradations.

On the other hand, upon performing the low-temperature gradation control mode, the control unit 7 controls the gradation of each pixel Vpix of the liquid-crystal display panel 2 based on the low-temperature gradation control data D2. The low-temperature gradation control data D2 includes the voltage values of the driving voltage Vd for the overdrive, and thereby the control unit 7 performs the overdrive when performing the low-temperature gradation control mode. In the overdrive, in order to increase the response speed of the liquid crystal LC when the response speed of the liquid crystal LC is decreased, a driving voltage Vd higher than a target driving voltage corresponding to a target gradation of the pixel Vpix is applied for a predetermined period of time. Assume a case in which the overdrive is performed in the low-temperature gradation control mode. When the target gradation is 80 gradation, for example, the target voltage value of the driving voltage Vd corresponding to 80 gradation is $Vd_{80}$; however, a voltage value that is higher than the target voltage value $Vd_{80}$ is applied. When applying the voltage value that is higher than the target voltage value $Vd_{80}$, the control unit 7 can apply a voltage value $Vd_{160}$ that is two times the target voltage value $Vd_{80}$, apply a voltage value obtained by multiplying the target voltage value $Vd_{80}$ by a predetermined coefficient (so-called "overdrive coefficient"), or apply the maximum voltage value $Vd_{255}$.

The description has been given in which a plurality of pieces of gradation control data are prepared according to the temperature of the usage environment; however, the data of the voltage values can be used in common between the modes. Specifically, a predetermined number of voltage values from a minimum voltage value to a maximum voltage are prepared. In the normal-temperature gradation control mode, each of the voltage values is used as a voltage value of the driving voltage corresponding to a gradation value as illustrated in FIG. 5. In the low-temperature gradation control mode, part of the predetermined number of voltage values is used as a voltage value of the driving voltage for overdrive as illustrated in FIG. 6.

When each of the voltage value $Vd_0$ to the voltage value $Vd_{126}$ is used as a voltage value corresponding to a target gradation in the low-temperature gradation control mode the low-temperature gradation control mode, a substantially half gradation of the input gradation may be used as the target gradation corresponding to the input gradation. For example, the target gradation of 0 is used for the input gradation of 0 or 1, the target gradation of 1 is used for the input gradation of 2 or 3, and the target gradation of 127 is used for the input gradation of 254 or 255. As a result, when the gradation of 0 or 1 is input, the voltage value $Vd_0$ is selected, when the gradation of 1 or 2 is input, the voltage value $Vd_1$ is selected, and when the gradation of 254 or 255 is input, the voltage value $Vd_{127}$ is selected. Such control sets the target gradation to a lower value, and shortens a time that the liquid crystal takes to achieve the target gradation. Accordingly, the response speed of the liquid crystal is improved even at the low temperature.

Figure 7:
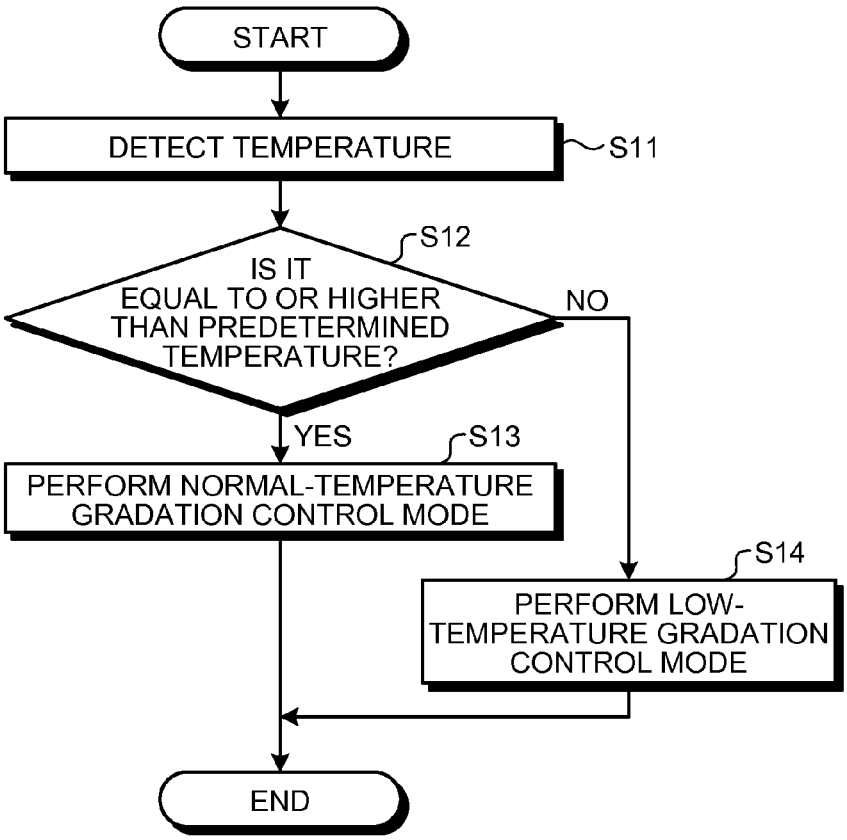
FIG. 7 is a flowchart of an example of a gradation control operation performed by a control unit.

A switch control of the gradation control mode by the control unit 7 is described next with reference to FIG. 7. First, the control unit 7 detects the temperature of the usage environment of the liquid-crystal display panel 2 by the temperature sensor 60 (Step S11). Thereafter, the control unit 7 determines whether the detected temperature is equal to or higher than a predetermined temperature (Step S12). The predetermined temperature is a temperature at which the response speed of the liquid crystal LC is decreased, and is set to an arbitrary temperature. The predetermined temperature is, for example, −30° C. When it is determined that the detected temperature is equal to or higher than the predetermined temperature (YES at Step S12), the control unit 7 performs the normal-temperature gradation control mode (Step S13), and ends the execution of the switch control. On the other hand, when it is determined that the detected temperature is lower the predetermined temperature (NO at Step S12), the control unit 7 performs the low-temperature gradation control mode (Step S14), and ends the execution of the switch control. The control unit 7 repeatedly executes the switch control for each predetermined cycle.

In this manner, the liquid-crystal display device 1 switches the gradation control mode between the normal-temperature gradation control mode and the low-temperature gradation control mode based on the detection result from the temperature sensor 60. Therefore, the number of gradation values from the minimum gradation value to the maximum gradation value in the low-temperature gradation control mode can be set smaller than that in the normal-temperature gradation control mode. As a result, a plurality of gradation values can be associated with a plurality of voltage values without increasing a predetermined number of voltage values (for example, 256 voltage values), and the voltage values corresponding to the reduced gradation values can be assigned as the voltage values for the overdrive. Accordingly, the control unit 7 can perform the so-called "overdrive" in which the driving voltage Vd that is higher than the target driving voltage associated with the target gradation is applied between the common electrode COML and the pixel electrode 72 by the driving circuit unit, in order to achieve the target gradation of the pixel Vpix in the low-temperature gradation control mode. Therefore, even when the response speed of the liquid crystal layer is slow, the control unit 7 can increase the response speed of the liquid crystal layer by performing the overdrive, and hence the target gradation can be swiftly achieved. At this time, because there is no need to increase a predetermined number of voltage values, it is possible to suppress an increase of the control load.

The liquid-crystal display device 1 can switch the gradation control mode between the normal-temperature gradation control mode and the low-temperature gradation control mode based on the temperature detected by the temperature sensor 60. Therefore, at the environment temperature at which the response speed of the liquid crystal LC decreases, the liquid-crystal display device 1 can execute the gradation control of the pixel Vpix in the low-temperature gradation control mode.

The liquid-crystal display device 1 can set the number of gradations from the minimum gradation value to the maximum gradation value in the low-temperature gradation control data D2 to a half of the number of gradations from the minimum gradation value to the maximum gradation value in the normal-temperature gradation control data D1. Therefore, the liquid-crystal display device 1 can use the same number of voltage values as the number of gradations as the voltage values for the overdrive while performing a 7-bit display of each pixel Vpix. As a result, the liquid-crystal display device 1 can swiftly perform the display operation of an image without significantly degrading the gradation representation of the image displayed on the liquid-crystal display panel 2 even when the temperature is low.

Although the gradation control mode is switched between the normal-temperature gradation control mode and the low-temperature gradation control mode by using the temperature sensor 60 in the liquid-crystal display device 1 according to the embodiment, the embodiment is not limited to using the temperature sensor 60. That is, any detection unit can be used so long as it is a status detection unit that can detect directly or indirectly detect a status of the response speed of the liquid crystal LC.

Although the gradation control mode is switched between the normal-temperature gradation control mode and the low-temperature gradation control mode by using two types of gradation control data including the normal-temperature gradation control data D1 and the low-temperature gradation control data D2 in the liquid-crystal display device 1 according to the embodiment, the embodiment is not limited thereto. For example, the gradation control mode can be appropriately switched among three or more gradation control modes by preparing three or more types of gradation control data.

Although the number of gradations from the minimum gradation value to the maximum gradation value in the low-temperature gradation control data D2 is set to a half of the number of gradations from the minimum gradation value to the maximum gradation value in the normal-temperature gradation control data D1 in the liquid-crystal display device 1 according to the embodiment, the embodiment is not limited thereto. That is, the number of gradations from the minimum gradation value to the maximum gradation value in the low-temperature gradation control data D2 can be set to an arbitrary number of gradations so long as the number of gradations from the minimum gradation value to the maximum gradation value in the low-temperature gradation control data D2 is smaller than the number of gradations from the minimum gradation value to the maximum gradation value in the normal-temperature gradation control data D1.

2. Evaluation Examples

Figure 8:
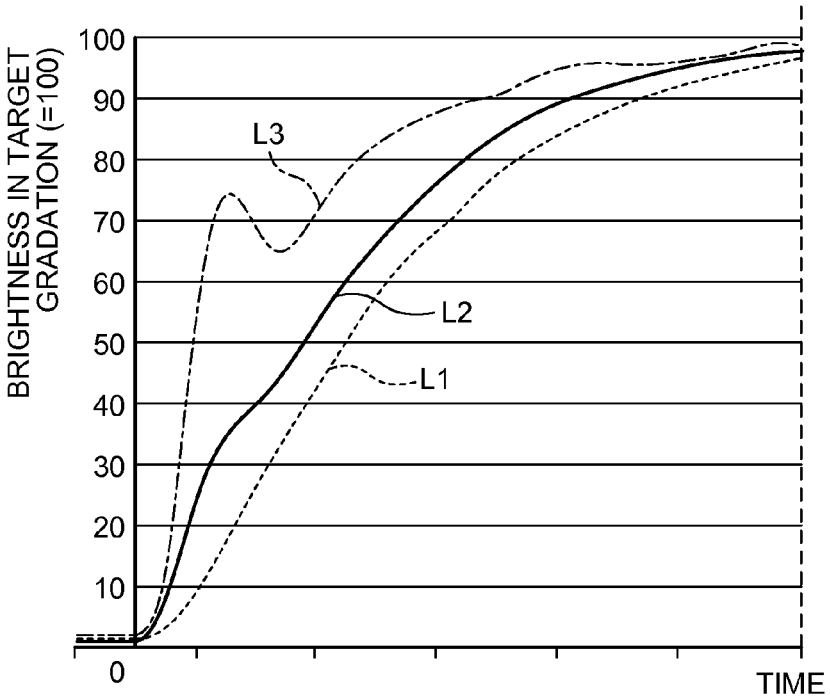
FIG. 8 is a graph representing brightness at a target gradation that changes with time.

In the present evaluation example, in order to evaluate the operation effect of the liquid-crystal display device 1 according to the embodiment, brightness at a target gradation that changes with time in the liquid-crystal display device 1 according to the embodiment is compared with brightness at a target gradation that changes with time in a conventional liquid-crystal display device. FIG. 8 is a graph representing brightness at a target gradation that changes with time. In the graph illustrated in FIG. 8, the horizontal axis represents time, and the vertical axis represents brightness (=100) at the target gradation.

In FIG. 8, L1 indicates the temporal change of the brightness in the conventional liquid-crystal display device when the gradation control of the pixel Vpix is executed without performing the overdrive. The gradation control of the L1 is a gradation control corresponding to the normal-temperature gradation control mode according to the embodiment. In the gradation control of the L1, the target gradation is set to 160 gradation, and the voltage value $Vd_{160}$ corresponding to the target gradation is applied as the driving voltage Vd without performing the overdrive.

In FIG. 8, L2 indicates the temporal change of the brightness in the conventional liquid-crystal display device when the gradation control of the pixel Vpix is executed by performing the overdrive. The gradation control of the L2 is also a gradation control corresponding to the normal-temperature gradation control mode according to the embodiment. In the gradation control of the L2, the target gradation is set to 160 gradation. In the gradation control of the L2, by performing the overdrive, the maximum voltage value $Vd_{255}$ that is larger than the voltage value $Vd_{160}$ corresponding to the target gradation is applied as the driving voltage Vd, and then the voltage value $Vd_{160}$ corresponding to the target gradation is applied. In order to accomplish such control, in the L2, more voltage values of the driving voltage Vd than the number of voltage values used in the 8-bit display are prepared.

In FIG. 8, L3 indicates the temporal change of the brightness in the liquid-crystal display device 1 according to the embodiment when the gradation control of the pixel Vpix is executed by performing the overdrive. That is, the gradation control of the L3 is a gradation control in the low-temperature gradation control mode according to the embodiment. In the gradation control of the L3, the target gradation is set to 80 gradation. In the gradation control of the L3, by performing the overdrive, the maximum voltage value $Vd_{255}$ that is larger than the voltage value $Vd_{80}$ corresponding to the target gradation is applied as the driving voltage Vd, and then the voltage value $Vd_{80}$ corresponding to the target gradation is applied.

In FIG. 8, the temperature in the usage environment of the liquid-crystal display device 1 is a temperature lower than a predetermined temperature. As illustrated in FIG. 8, comparing the brightness at a predetermined time among the L1, the L2, and the L3, it is found that the L3 exhibits the highest brightness, followed by the L2, and the L3 exhibits the lowest brightness. Accordingly, it is confirmed that the liquid-crystal display device 1 according to the embodiment can swiftly arrive at the brightness at the target gradation by performing the low-temperature gradation control mode in a low-temperature usage environment.

3. Application Example

Figure 9:
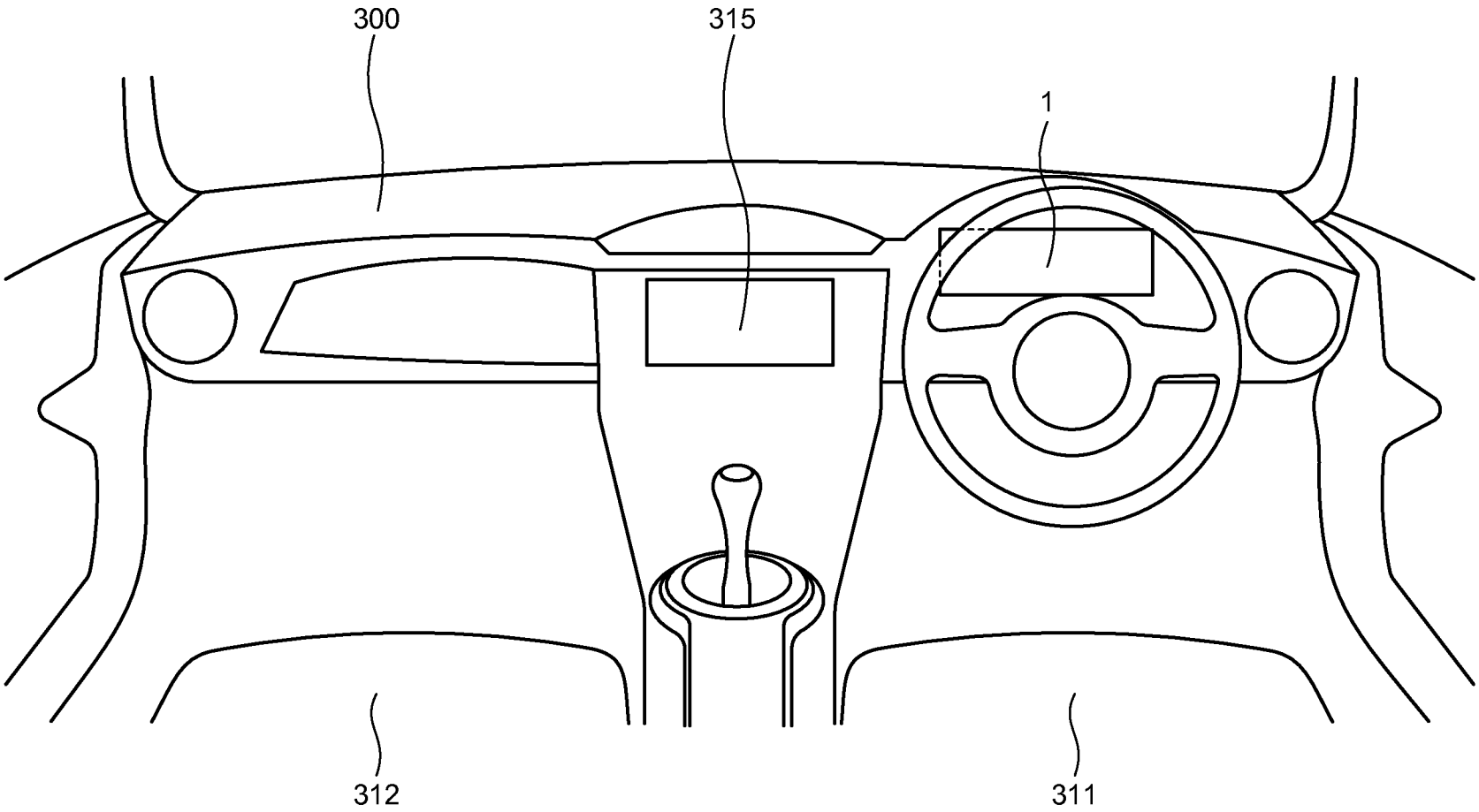
FIG. 9 illustrates a state where the liquid-crystal display device according to the embodiment is installed in a dashboard of a vehicle.
Figure 10:
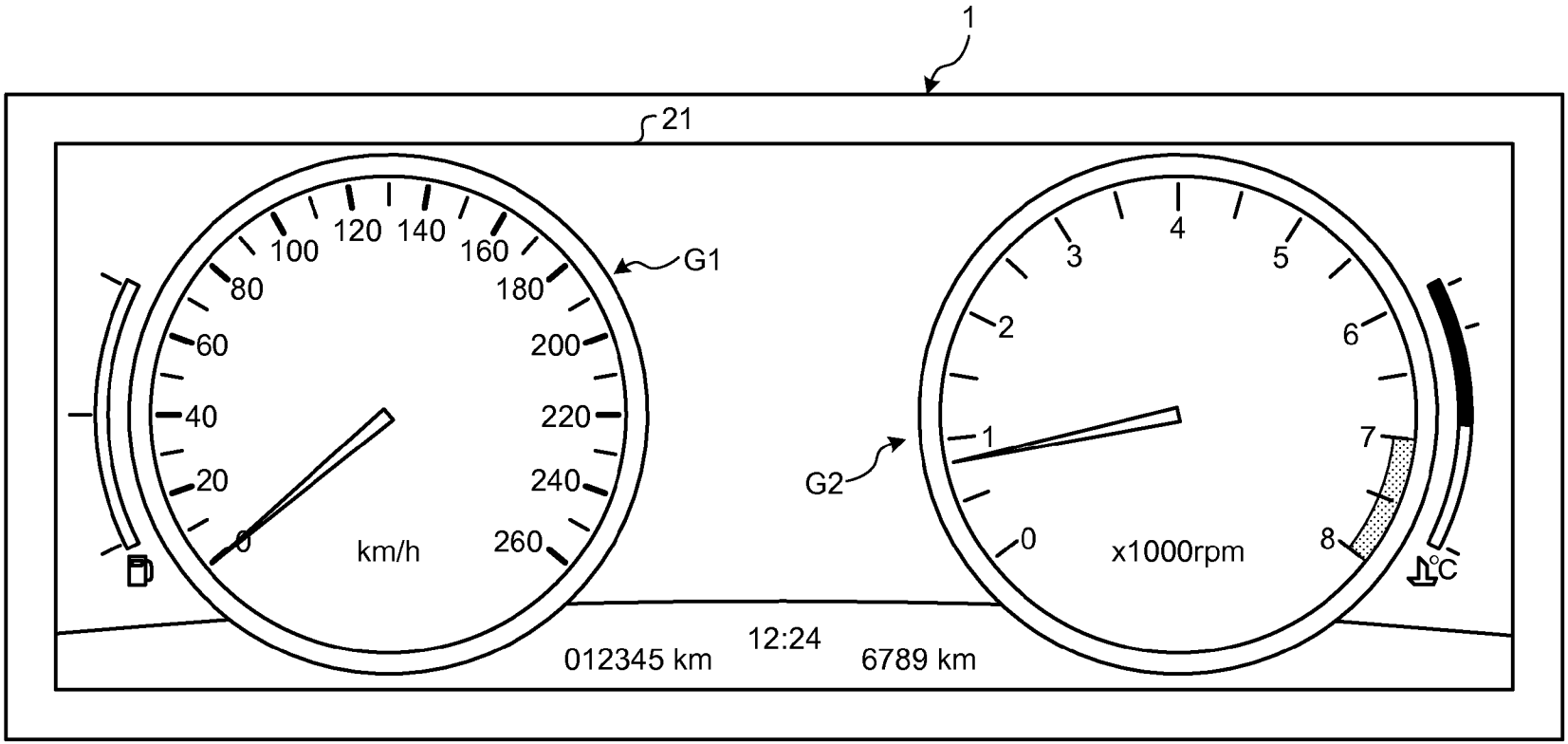
FIG. 10 is an example of an image displayed on the liquid-crystal display device according to the embodiment.

An application example of the liquid-crystal display device 1 described in the embodiment is explained below with reference to FIGS. 9 and 10. FIG. 9 illustrates a state where the liquid-crystal display device according to the embodiment is installed in a dashboard of a vehicle. FIG. 10 is an example of an image displayed on the liquid-crystal display device according to the embodiment.

As illustrated in FIG. 9, for example, the liquid-crystal display device 1 according to the embodiment is installed in a dashboard 300 on a driver's side in a vehicle. In this case, the liquid-crystal display device 1 is used as an instrument panel that can display speed and rpm. As illustrated in FIG. 10, when the liquid-crystal display device 1 is used as the instrument panel, an image G1 of a speedometer is displayed on one side (the left side in FIG. 10) in a longitudinal direction of a display area 21 of the liquid-crystal display device 1, and an image G2 of a tachometer is displayed on the other side (the right side in FIG. 10) in the longitudinal direction.

The liquid-crystal display device 1 according to the embodiment can also be applied to a car navigation device 315 installed in the dashboard 300 between a driver seat 311 and a passenger seat 312. In this case, the liquid-crystal display device 1 of the car navigation device 315 is used for a navigation display, a music-operation screen display, a movie play display, or the like.

The liquid-crystal display device 1 according to the embodiment can be applied to electronic apparatuses in various fields such as television devices, digital cameras, notebook PCs, mobile devices including mobile phones, video cameras, or the like, as well as the instrument panel and the car navigation device. In other words, the liquid-crystal display device 1 according to the embodiment can be applied to electronic apparatuses in any field, in which a video signal that is externally input or a video signal that is internally generated is displayed as an image or a video. The electronic apparatus includes a control device that supplies a video signal to the liquid-crystal display panel and controls an operation of the liquid-crystal display panel.

The embodiment is not limited to the above descriptions. Constituent elements in the above embodiments include those that can be easily conceived by persons skilled in the art, those that are substantially identical thereto, and those within the range of equivalence. Furthermore, these constituent elements can be variously omitted, replaced, or modified without departing from the scope of the above embodiments.

4. Aspects of the Present Disclosure

The present disclosure includes aspects as follows.

(1) A liquid-crystal display device comprising:

a pixel electrode provided for each pixel;

a common electrode for supplying a common potential to the pixel;

a liquid crystal layer arranged between the pixel electrode and the common electrode;

a driving circuit unit for supplying a pixel potential to the pixel electrode so that that a driving voltage is applied between the common electrode and the pixel electrode;

a status detection unit that detects a response speed of the liquid crystal layer; and a control unit that controls a gradation of the pixel by controlling the driving voltage, wherein the control unit switches between a first gradation control mode and a second gradation control mode based on a detection result from the status detection unit, the first gradation control mode is selected when the response speed of the liquid crystal layer is higher than a predetermined speed, the second gradation control mode is selected when the response speed of the liquid crystal layer is not higher than the predetermined speed in the first gradation control mode, a predetermined number of voltage values of the driving voltage from a minimum voltage value to a maximum voltage value are prepared, and the predetermined number of voltage values are associated with a plurality of gradation values from a minimum gradation value to a maximum gradation value, in the second gradation control mode, a plurality of voltage values from the minimum voltage value to a predetermined voltage value among the predetermined number of voltage values are associated with a plurality of gradation values from a minimum gradation value to a maximum gradation value, whose number is smaller than that in the first gradation control mode, and a plurality of voltage values from the predetermined voltage value to the maximum voltage value among the predetermined number of voltage values are set as voltage values for overdrive for applying a voltage value that is higher than the driving voltage of the voltage value associated with the gradation value.

(2) The liquid-crystal display device according to (1), wherein the status detection unit includes a temperature detection unit that measures a temperature of a usage environment, and the control unit switches the gradation control mode to the first gradation control mode when the temperature detected by the temperature detection unit is higher than a predetermined temperature, and switches the gradation control mode to the second gradation control mode when the temperature detected by the temperature detection unit is n (3) The liquid-crystal display device according to (1), wherein number of gradations in the second gradation control mode is a half of number of gradations in the first gradation control mode.

(4) An electronic apparatus comprising the liquid-crystal display device according to (1).

(5) A liquid-crystal display device comprising:

a liquid crystal layer including a pixel;

a driving circuit unit for applying a driving voltage to the pixel;

a status detection unit that detects a response speed of the liquid crystal layer; and a control unit that controls a gradation of the pixel by controlling the driving voltage, wherein the control unit switches between a first mode and a second mode based on a detection result from the status detection unit, in the first mode, the control unit uses each of a predetermined number of voltage values from a minimum voltage value to a maximum voltage as a voltage value of the driving voltage corresponding to a gradation value, and in the second mode, the control unit uses part of the predetermined number of voltage values as a voltage value of the driving voltage for overdrive.

In the liquid-crystal display device having the above-mentioned configuration and in the electronic apparatus including the liquid-crystal display device, a gradation control mode is switched to the second gradation control mode when the response speed of the liquid crystal layer is slow. Therefore, a plurality of gradation values from the minimum gradation value to the maximum gradation value in the second gradation control mode can be reduced to a value that is smaller than that of the first gradation control mode. As a result, a plurality of gradation values can be associated with a plurality of voltage values without increasing a predetermined number of voltage values, and the voltage values corresponding to the reduced gradation values can be used as the voltage values for the overdrive. Therefore, in the second gradation control mode, the control unit can perform the so-called "overdrive", in which the driving voltage that is higher than a target driving voltage associated with a target gradation can be applied between the common electrode and the pixel electrode by the driving circuit unit in order to achieve the target gradation of the pixel. Accordingly, even when the response speed of the liquid crystal layer is slow, the control unit can improve the response speed of the liquid crystal layer by performing the overdrive, and hence the target gradation can be swiftly achieved. At this time, because a predetermined number of voltage values need not be increased, it is possible to suppress an increase of the control load.

According to one of the embodiments, when the response speed of the liquid crystal layer is slow, the gradation control mode is switched to the second gradation control mode. Consequently, the response speed of the liquid crystal layer can be improved by performing the overdrive while suppressing an increase of the control load, thus swiftly achieving the target gradation.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A liquid-crystal display device comprising:

a pixel electrode provided for each pixel;

a common electrode for supplying a common potential to the pixel;

a liquid crystal layer arranged between the pixel electrode and the common electrode;

a driving circuit unit for supplying a pixel potential to the pixel electrode so that a driving voltage is applied between the common electrode and the pixel electrode;

a status detection unit that detects a response speed of the liquid crystal layer; and a control unit that controls a gradation of the pixel by controlling the driving voltage, wherein the control unit switches between a first gradation control mode and a second gradation control mode based on a detection result from the status detection unit, the first gradation control mode is selected when the response speed of the liquid crystal layer is higher than a predetermined speed, and the second gradation control mode is selected when the response speed of the liquid crystal layer is not higher than the predetermined speed;

wherein first voltage values of the first gradation control mode are a predetermined number of voltage values of the driving voltage from a minimum voltage value to a maximum voltage value, the first voltage values are associated with a plurality of first gradation values from a first minimum gradation value to a first maximum gradation value, and the first maximum gradation value is associated with the maximum voltage value;

wherein second voltage values of the second gradation control mode are a plurality of voltage values from the minimum voltage value to a predetermined voltage value selected from the predetermined number of voltage values, the predetermined voltage value being smaller than the maximum voltage value;

wherein the second voltage values are associated with a plurality of second gradation values from a second minimum gradation value to a second maximum gradation value that is associated with the predetermined voltage value and that is smaller than the maximum gradation value;

wherein a total number of the second gradation values is smaller than a total number of the first gradation values, allowing the liquid-crystal display device to have a total number of displayable gradations in the second gradation control mode to be smaller than a total number of displayable gradations in the first gradation control mode;

wherein third voltage values, which are selected from voltage values in a range greater than the predetermined voltage value to the maximum voltage value of the predetermined number of voltage values are set as voltage values for overdrive in the second gradation control mode;

wherein the third voltage values are higher than the second voltage values and are associated with third gradation values that are in a range greater than the second maximum gradation value to the first maximum gradation value;

wherein a correlation between second gradation values and voltage values in the second gradation control mode is the same as that in the first gradation control mode in a range from the minimum voltage value to the predetermined voltage value;

wherein the first minimum gradation value and the second minimum gradation value that have an equal value are associated with the minimum voltage value; and wherein the second voltages corresponding to continuous second gradation values are the same as the first voltages corresponding to continuous first gradation values that are same as the continuous second gradation values.

2. The liquid-crystal display device according to claim 1, wherein the status detection unit includes a temperature detection unit that measures a temperature of a usage environment, and wherein the control unit is configured to switch the gradation control mode to the first gradation control mode when the temperature detected by the temperature detection unit is higher than a predetermined temperature, and switch the gradation control mode to the second gradation control mode when the temperature detected by the temperature detection unit is not higher than the predetermined temperature.

3. The liquid-crystal display device according to claim 1, wherein the total number of the second gradation values is half of the total number of the first gradation values.

4. An electronic apparatus comprising the liquid-crystal display device according to claim 1.

5. The liquid-crystal display device according to claim 1, wherein, in second gradation control mode, the control unit sets an overdrive voltage value corresponding to a target gradation value to be in a range of the second voltage values corresponding to gradation values higher than the target gradation value in the second voltage values or in the third voltage values, and the overdrive voltage value is higher than a target voltage value that corresponds to the target gradation value in the second voltage values.

6. The liquid-crystal display device according to claim 5, wherein the overdrive voltage is set to be a voltage value obtained by multiplying the target voltage value by a predetermined overdrive coefficient.

7. The liquid-crystal display device according to claim 6, wherein the predetermined overdrive coefficient is two.

8. The liquid-crystal display device according to claim 5, wherein the overdrive voltage is set to be the maximum voltage value.

* * * * *